US005355899A

United States Patent [19]

Kuo-Hua

[11] Patent Number: 5,355,899

[45] Date of Patent: Oct. 18, 1994

[54] ARCHED HAIRCLIP

[76] Inventor: Chou Kuo-Hua, Suite 1, 11F, 95-8 Chang Ping Road, Sec. 1, Taichung, Taiwan

[21] Appl. No.: 89,168

[22] Filed: Jul. 9, 1993

[51] Int. Cl.[5] ..... A45D 8/22

[52] U.S. Cl. ..... 132/279; 132/278

[58] Field of Search ..... 132/276, 277, 278, 279

[56] References Cited

U.S. PATENT DOCUMENTS 4,976,277 12/1990 Yasuda ..... 132/279

5,109,878 5/1992 Kuo-Hua ..... 132/278

FOREIGN PATENT DOCUMENTS 2215202 9/1989 United Kingdom ..... 132/278

*Primary Examiner*—Gene Mancene

*Assistant Examiner*—Frank A. LaViola

[57] ABSTRACT

An arched hairclip comprises generally an elongate base piece and an elongate tongue piece in arcuate form and pivotally connected with one of their corresponding ends. The base piece has on one end a retainer and the other end a pair of hinge rings. The tongue piece has on one end a buckle member and the other end a pair of the hinge pins, an undulated spring strip integral with and underneath the tongue piece has a cylinder member on free end which displaceably stops against the inward wall of the buckle member providing a great flexibility to the hairclip. This disclosure has been characterized in the adjustable function which prevents a hair bundle therein from being broken by the shearing action and protects the hairclip from sliding off a hair bundle.

9 Claims, 10 Drawing Sheets

ARCHED HAIRCLIP

BACKGROUND OF THE PRESENT INVENTION

The present invention relates to the structure of an arched hairclip and more particularly to an arched hairclip which can be adjustably and effectively bound hair without damaging the hair.

According to the prior art hairclip, the structure is slightly bowed in the form of a long arch comprising a smooth upper strip showing a carved out slot in the length and a flexed smooth middle strip projecting towards a tongue and embedded in the tongue when the tongue is in closed position. When this type of hairclip used to bind hair, the central carved out slot of the upper strip is exposed and a shearing force occurred in between the upper strip being the tongue that has one end pivotally connected to the upper strip; the other end is held by retainer mechanism from the upper strip.

However, when the upper strip is pressed against the tongue to unfasten the hairclip, the upper strip would become momentarily depressed and together with the middle strip perform a shearing act cutting off some of the hair bundle thereinbetween. Perhaps, under certain particular circumstances such as to a especially fine hair or coarse hair, a traditional hairclip may not be able to bind the hair lightly and the hairclip may fall down as it would slide off the direction of the hair bundle or as the hair is too thick for the hairclip to work. These problems are due to the fact that the strips of the hairclip grip in a fixed way without adjustable and selective fastening function to accommodate with different hair characteristics.

SUMMARY OF THE PRESENT INVENTION

The main object of the present invention is to provide a new structure of arched hairclip for stepped binding the different hair bundle therein to enable an elastic and adjustable function to bind hair.

Accordingly, the present invention of an arched hairclip comprises a basepiece and a tongue piece, pivotally connected to one of their corresponding ends thereof.

The basepiece has a pair of hinge rings at one end defining a rectangular receiving space therein between, an elongate slot along the axis and occupied a substantial part of the length of the base piece and a retainer at the other end. That holder is an inward bent strip metal having an entrance opened on the top, a first and a second guiding members formed on right and left respectively. A number of gripping means including spaces on the left side and a narrow slit beside the first guiding member providing convenience for sliding a buckle member in and out of the retainer.

The tongue piece comprises an upper portion in the shape of a slightly arcuate strip and a lower portion of a greatly arcuate undulated strip having at one end a buckle member and the other end a pair of the protruding tabs which are integral with the tongue piece. Both the upper and the lower portions having an elongate slot along their central axis, a spring plate abutted the protruding tabs and a cylinder end on the lower portion.

To assemble this invention, simply insert the protruding tabs of the tongue piece into the hinge rings of the basepiece and releasably engage the buckle with the retainer if in close position. The engagement is performed simply press down the buckle of the tongue piece sliding into the retainer of the basepiece as being guided by the first and second guiding members and then locked by the first or the second gripping means.

A BRIEF DESCRIPTION OF THE DRAWINGS

DETAIL DESCRIPTION OF THE PREFERRED EMBODIMENT OF THE PRESENT INVENTION

Figure 1:
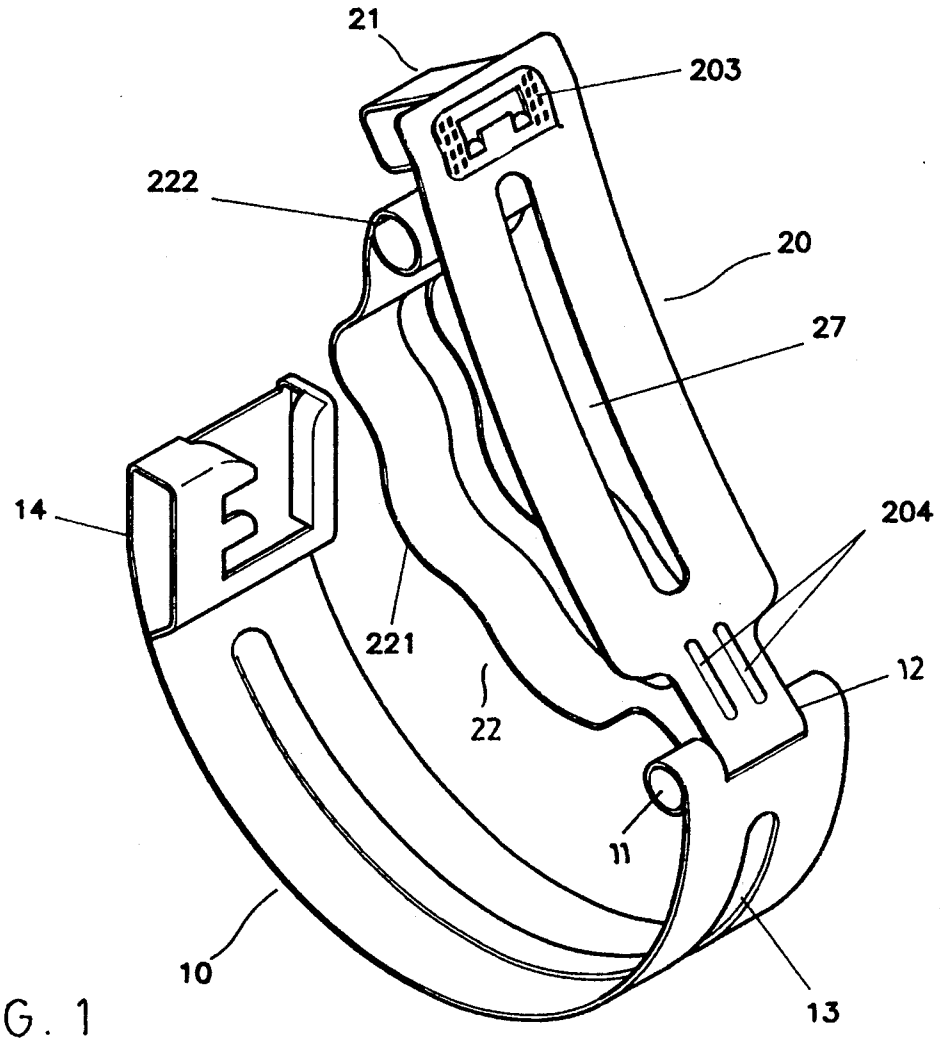
FIG. 1 is a perspective view of an unfastened arched hairclip of a first embodiment according to the present invention.
Figure 2:
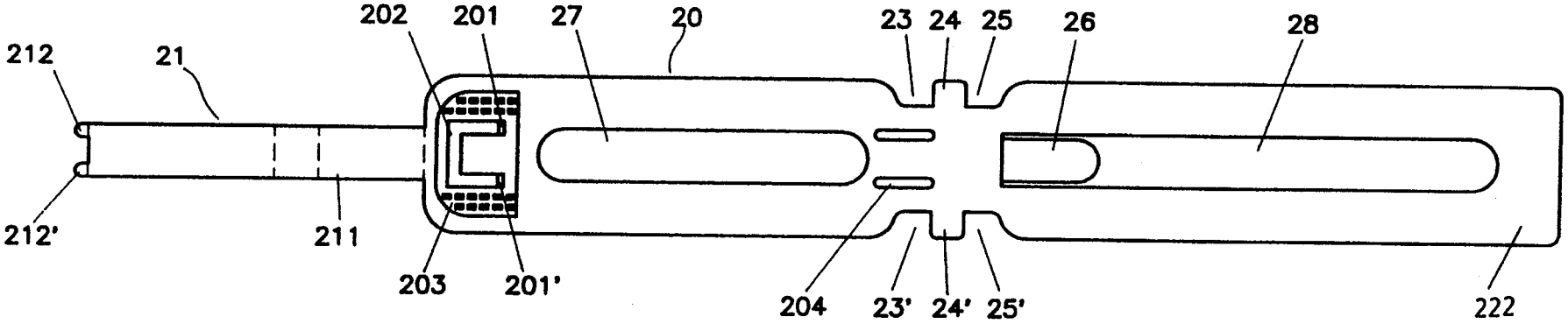
FIG. 2 is a plan view of a spread out tongue piece of the first embodiment according to the present invention.

Referring to FIG. 1, an arched hairclip comprises a bowed basepiece 10 and a tongue piece 20 pivotally connected with their corresponding ends, wherein the top view of the spread out tongue piece 20 before bending is shown in FIG. 2. Which is in the form of a elongate strip with an inwardly stepped portion to form a fastening member 21 extending outwardly from the first end. The fastening member 21 comprises a strip body 211, a pair of tips 212 and 212' laterally extended from the free end and two pairs of transverse broken lines parallel disposed on appropriate portions to indicate where to be bent over. The tongue piece 20 further comprises a press knurling 203 in a position adjacent the strip body 211 having two retaining recesses 201 and 201' and an U-shape reinforcement groove 202, with a depth equal to the thickness of the tongue piece 20, and abutting the pair of the retaining recesses 201, a pair of symmetrically and laterally protruding tabs 24 and 24' on the two sides of its mid-portion abutting two pairs of the inwardly stepped spaces 23, 25, 23' and 25, two elongate slots 27 and 28 parallel to the direction of the axis integral with a spring plate 26 on the inward end of one of the slots 27 and 28, which is pieced out of the metal of the a tongue piece 20 leaving a pair of clearances on the lateral sides, and a pair of the elongate reinforcement slits 204 spacedly formed along the axis and positioned between the slots 27 and 28. The strip body 211 of the tongue piece 20 is then bent downward (along the broken lines as shown in FIG. 2) to form a rectangular buckle member 21, the other end is bent into an arch with the protruding tabs 24 and 24' as a turning point which become a pair of hinge pins pivoted to the pair of hinge rings 11 of the basepiece 10.

Figure 3:
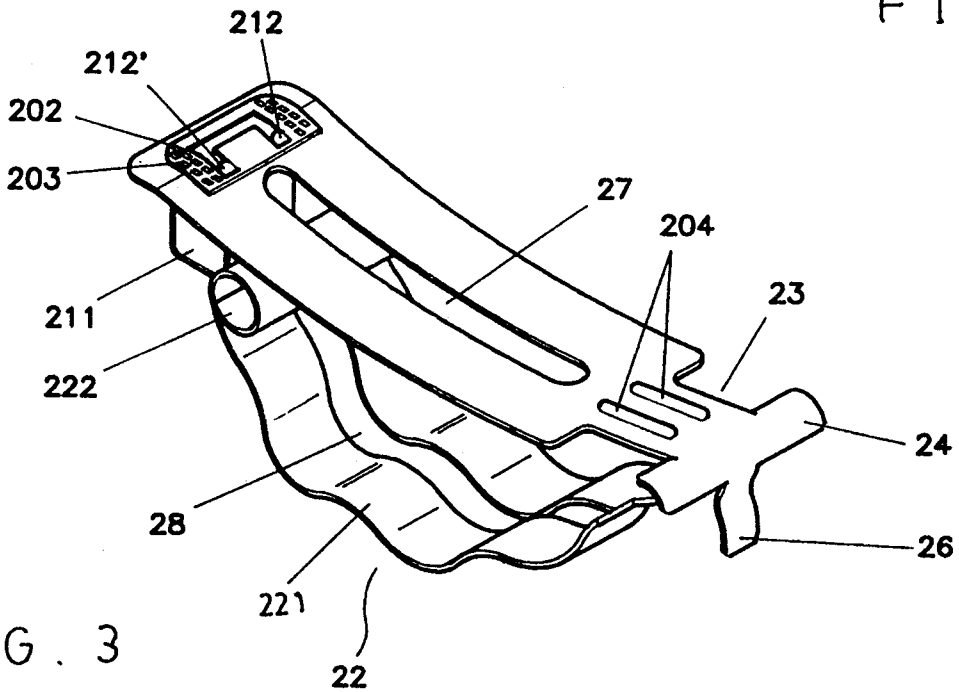
FIG. 3 is a perspective view of the tongue piece of the first embodiment according to the present invention.

The right side of the tongue piece 20 is now turned over and pressed to an undulated spring strip 22 having a cylinder free end 222 which is tensely engaged with the inward side of the buckle member 21. The spring plate 26 is bent downward and left away from the slot 28. FIG. 3 shows the left side of the Tongue piece 20 is bent into a slightly flat arch and the right side into greater arcuate with a shortened inwardly stepped portion adjacent the protruding tabs 24 and 24.

Figure 4:
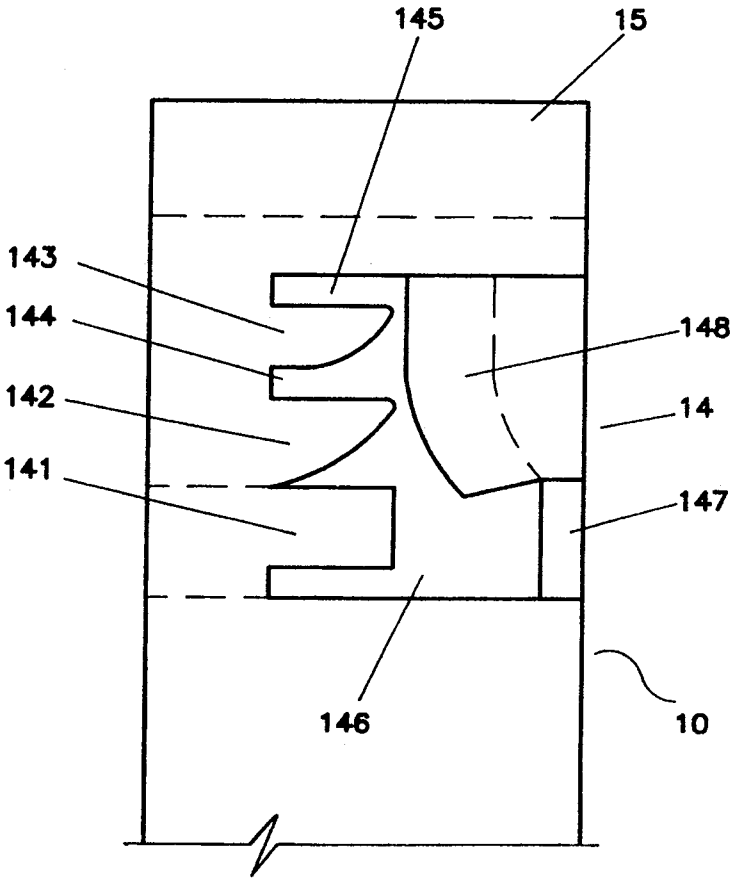
FIG. 4 is a sectional plan view of a spread out retainer of the arched base piece of the first embodiment according to the present invention.
Figure 5:
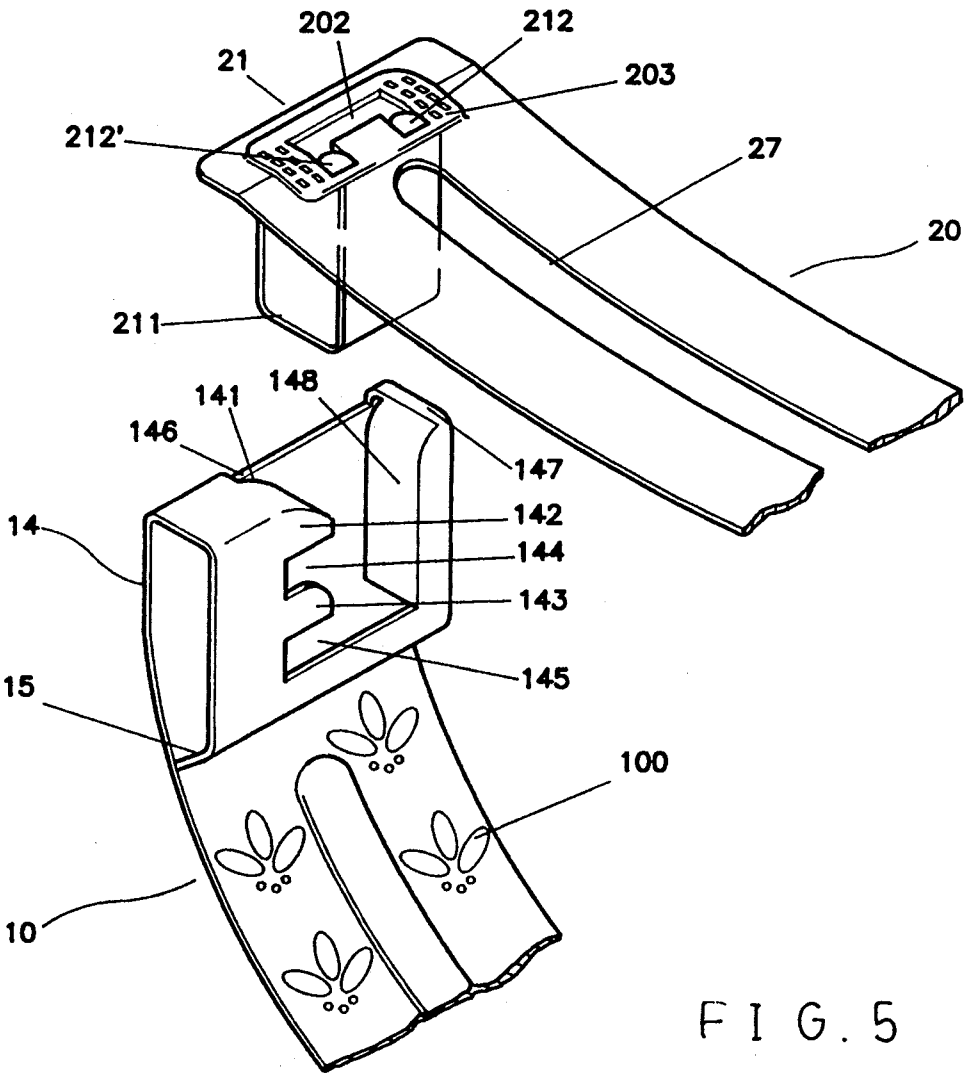
FIG. 5 is a perspective view showing the retainer and the buckle member of the first embodiment according to the present invention.

Referring to FIG. 1, 4 and 5, the base piece 10 comprises a greatly arched body, a pair of hinge rings 11 laterally formed on one end defining a rectangular receiving space 12 thereinbetween, an elongate slot 13 extended centrally of the body for a substantial part of the length of the body and a retainer 14 formed on the other end. FIG. 4 shows a spread out form of the retainer 14 which comprises a plurality of the broken lines indicating the predetermined bending positions, a carved out space 146 including a narrow portion in a width slightly larger than the thickness of the body above the lowest broken line, a first guiding member 141 following the central line of symmetry, a first gripping means 142 and a second gripping means 143, carved out spaces formed a first locking space 144 and a second locking space 145 on the left side and a bent member 148 and a second guiding member 147 on the right side. The broken line on the bent member 148 appears straight in the upper and curved at the bottom shapely in accommodating with the bent member 148. The middle broken line is the axis of symmetry. Above the highest broken line is a top bent member 15, when the retainer 14 is formed by bending over along the broken lines with the edge of the top bent member 15 engaged the inward surface of the body as shown in FIG. 5, the bent member 148 is connected to part of the second guiding member 147 so as the first guiding member 141 is engaged with the first gripping means 142 and covers the top thereon. Wherein the narrow portion of the carved out space 146 becomes an opening beside the first gripping member 142 to facilitate the insertion in of the buckle member 21.

On the other hand, the basepiece 10 can also be pattern-pressed 100 directly so as to eliminate the steps for attaching ornamental boards rendering the manufacturing process more economical (as shown in FIG. 5).

Figure 6:
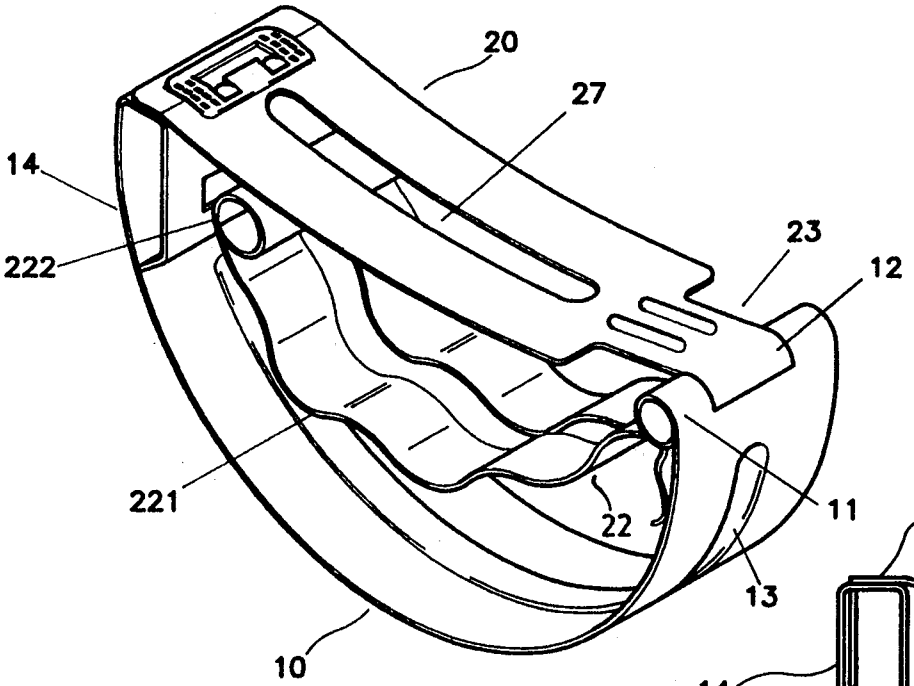
FIG. 6 is a perspective view of a fastened arched hairclip of the first embodiment according to the present invention.

Referring to FIG. 6, to assembly is to pivotally connect the corresponding ends of the basepiece 10 and the tongue piece 20 together as recited above in the manner such that to insert the tips 212 and 212' into the hinge rings 11 respectively as the spring plate 26 of the tongue piece 20 is pressed against the inward periphery of the basepiece 10, providing sufficient resilient force to urge the tongue piece 20 away from the base piece 10. When the tongue piece 20 is in the closed position, the buckle member thereof is releasably engaged with the retainer 14 therein and locked by the first or the second locking spaces 144 and 145. Meanwhile, the undulated spring strip 22 leaves a space between the inward periphery of the base piece 10.

Figure 7:
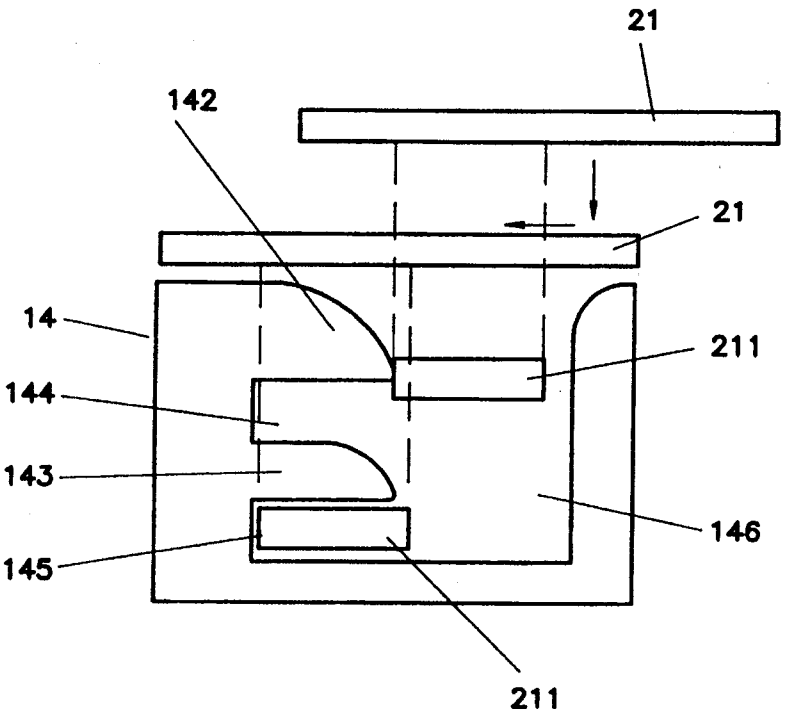
FIG. 7 is a sectional view showing the engagement of the buckle member to the retainer of the first embodiment according to the present invention.
Figure 8:
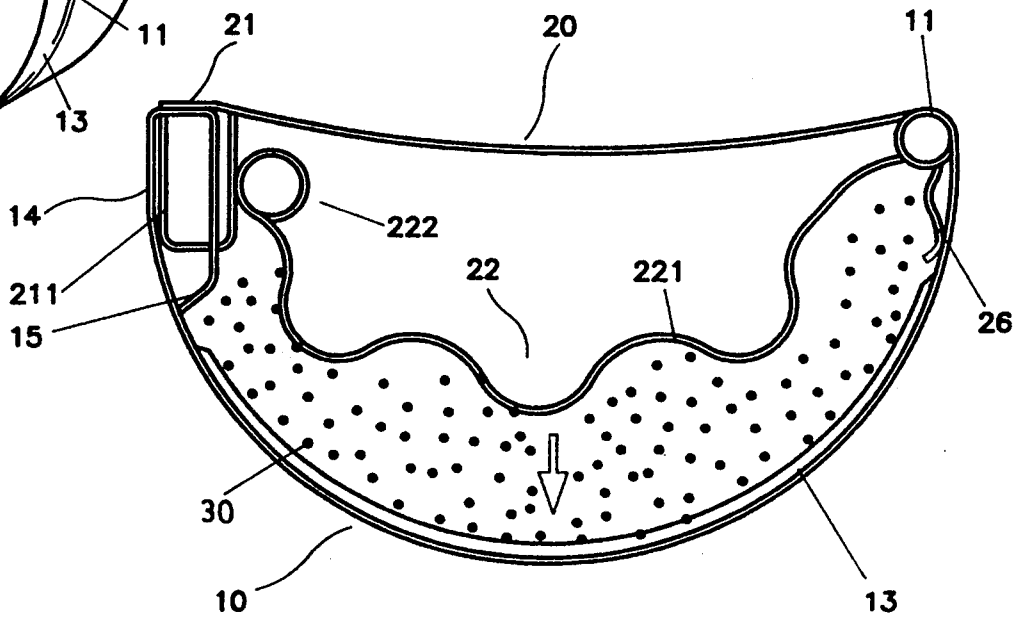
FIG. 8 is a sectional front view of the first embodiment according to the present invention, showing how the hair is bound in the hairclip.

With referring to FIGS. 7 and 8, during the application, a hair bundle is bound by the hairclip; the undulated spring strip 22 is forced upward by the hair bundle against the buckle member 21 of the tongue piece 20, pushing the buckle member 21 towards the base piece 10 so as to make it sliding into the retainer 14 via the right side relative to the central line thereof between the first and the second guiding members 141 and 147.

The selection of locking in the first or the second locking space 144 and 145 by the user of the hairclip depends on the volume of the hair bundle 30. When the hair is bound therein, the buckle member 21 of the tongue piece 20 is pressed downward to force the spring strip 22 towards the elongate slot 13 of the base piece 10; the hair within would therefore force back the spring strip 22 forming an elastic space to bind the hair tightly. Also, since the hair is bound in wave form between the elongate slot 13 and the elongate slot 28 of the tongue piece 20, there would be no shearing action occurred and the hair bundle can tightly bind without sliding off, thus improving its usefulness.

Another advantage of this invention worth mentioning relates to the design that the tongue piece 20 is close to the spring strip at the position of the protruding tabs 24 and 24' so that the hair can be evenly divided between two sides and effectively bound in average portions. Further, the cylinder end 222 of the spring strip 22 can move in and out freely without catching the hair during unfastening the hairclip.

FIG. 9 to 16 illustrate another preferred embodiment according to the present invention.

Figure 9:
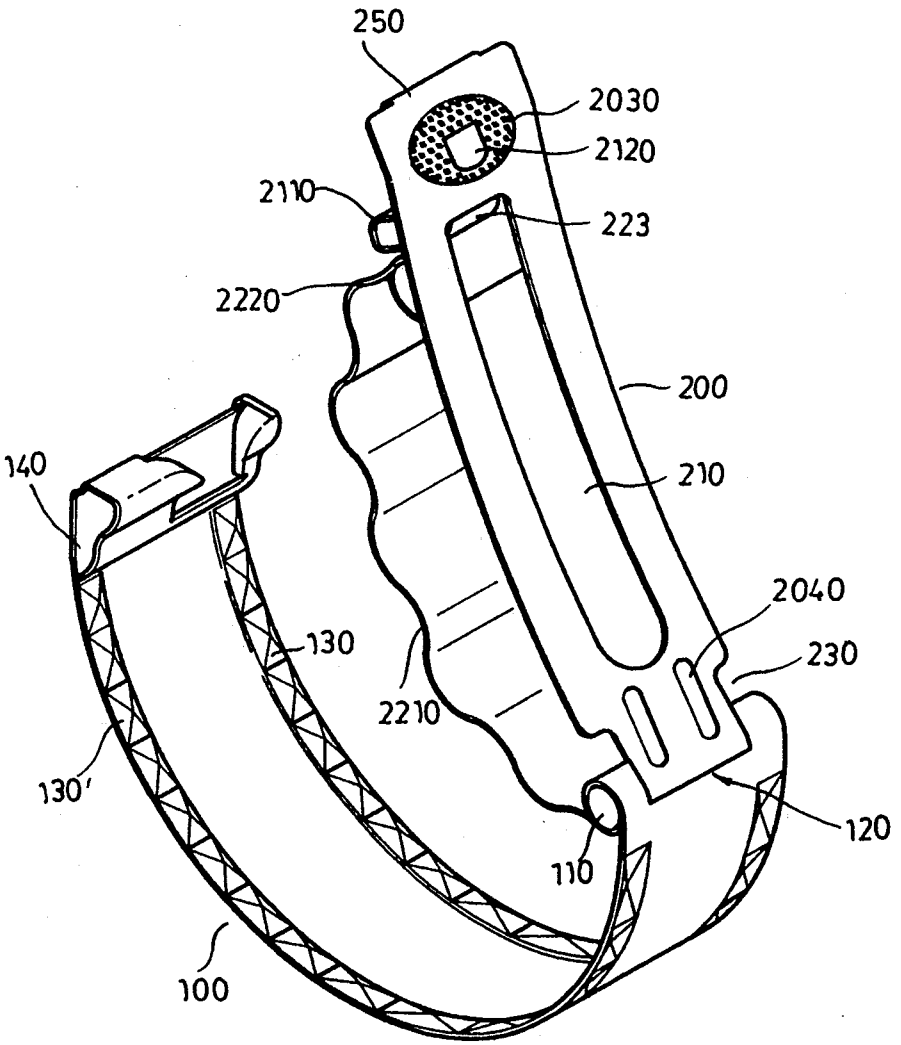
FIG. 9 is a perspective view of an unfastened arched hairclip of a second embodiment according to the present invention.
Figure 10:
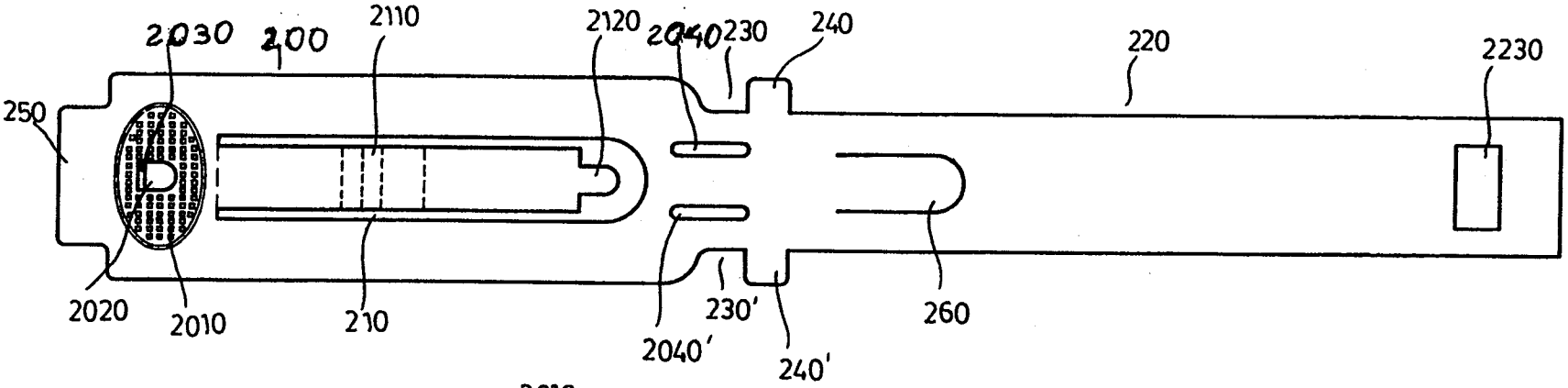
FIG. 10 is a plan view of a spread out tongue piece of the second embodiment according to the present invention.
Figure 12:
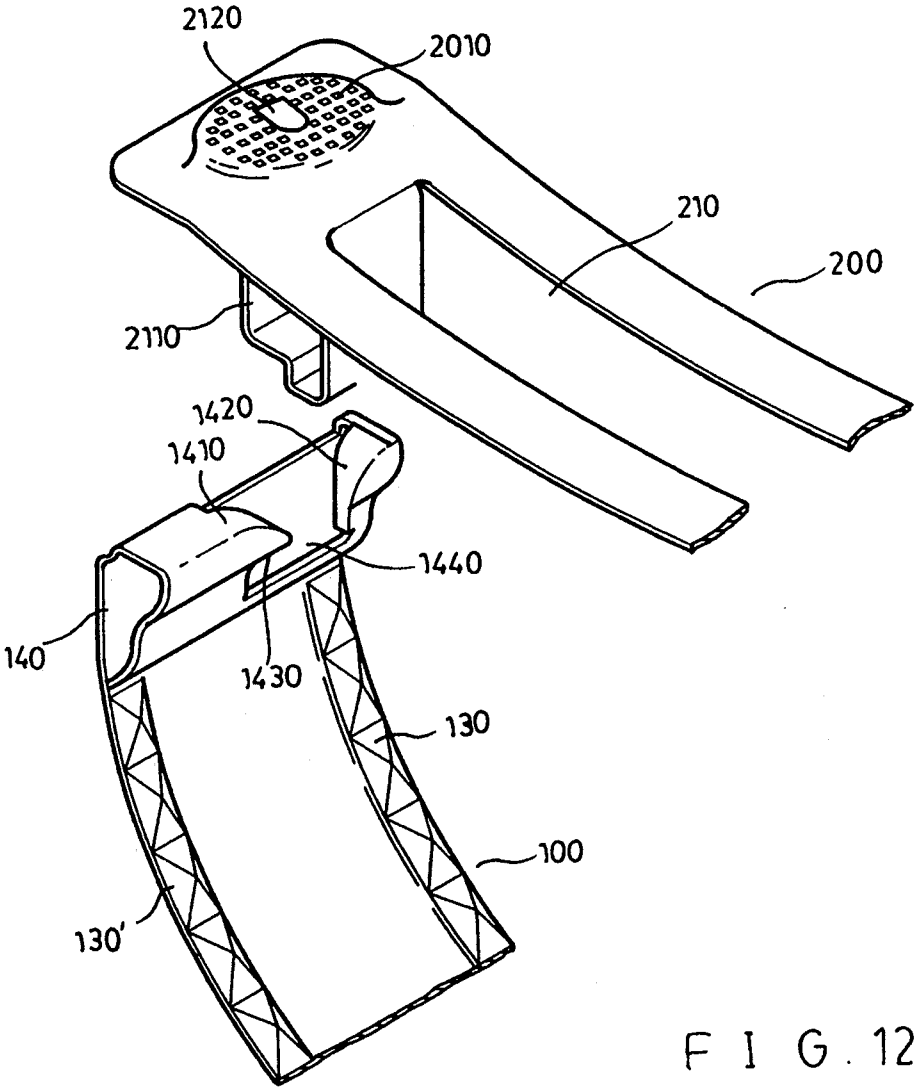
FIG. 12 is a exploded perspective view showing the retainer and the buckle member of the second embodiment according to the present invention.

Referring to FIG. 9, an arched hairclip comprises an base piece 100 and tongue piece 200 pivotally connected on one of their corresponding ends wherein the top view of the spread out tongue plate 200 before bending is shown in FIG. 10. The tongue piece 200 before folded over is in the form of an elongate strip comprising an inward stepped tip 250 extending from one end, an oval shaped knurling 2010 roughened on one end of the tongue piece 200 adjacent the tip 250, a receiving groove 2020 at the central of the knurling 2010 thereof abutting a retaining recess 2030, an elongate slot 210 provided along the axis of the tongue piece 200 which occupies about one third of the length of the elongate strip, a buckle member 2110 in strip form which is taken from the intermediate portion of the slot 210 having a narrower fixing tip 2120 on the free end and a plurality of the broken lines spacedly disposed on medial portion thereof which indicate that the buckle member 2110 is lately folded upon the broken lines into a roughly W shaped buckle and the tip 2120 thereof is retained in the receiving groove 2020 (as shown in FIG. 12), a pair of symmetrically and laterally protruding tabs 240 and 240' extended from two sides of its mid-section abutting a pair of inward stepped spaces 230 and 230, a pair of smaller reinforcement slots 2040 and 2040' spacedly formed between the slot 210 and the protruding tabs 240 and 240', an U-shape spring plate 260 which is cutted away from the elongate strip and a rectangular hole 2230 positioned in the proximity of the other free end thereof. Further, the right side of the elongate strip becomes narrower than it's left side thereof from the pair of the protruding tabs 240 and 240'.

Figure 11:
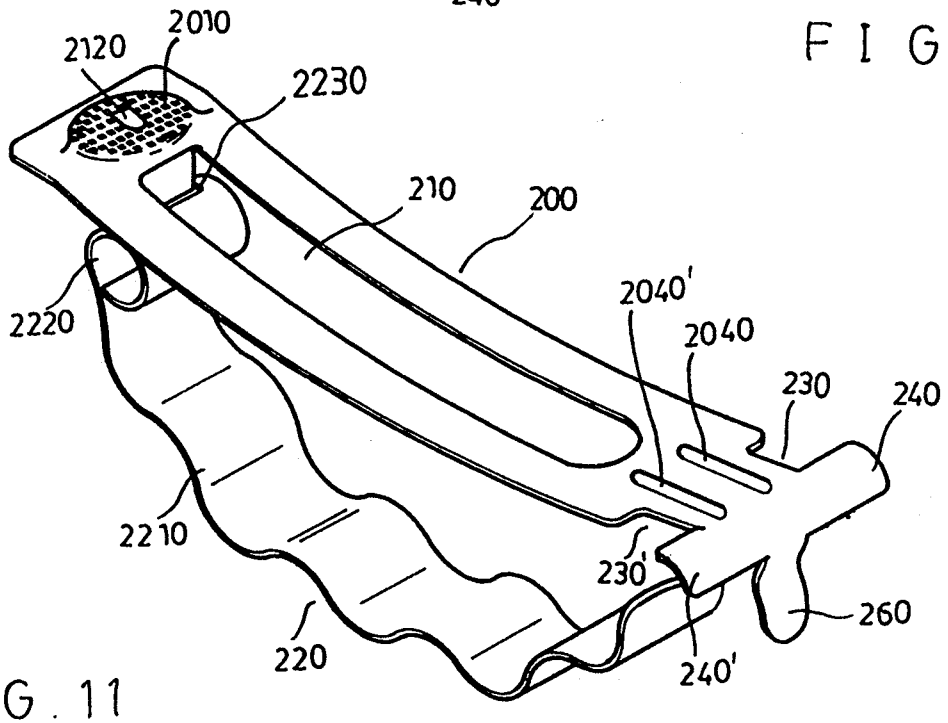
FIG. 11 is a perspective view of the tongue piece of the second embodiment according to the present invention.

The right side of the strip is then bent downwardly upon the tabs 240 and 240' to form a undulated portion 2210 having a cylinder end 2220 that becomes a spring strip 220 of the tongue piece 200 and the tabs 240 and 240', become a pair of hinge pins thereof. Referring to FIG. 11, the left side of the tongue piece 200 is bent into a slightly flat arch with a shortened neck between the protruding tabs 240 and 240'.

Figure 13:
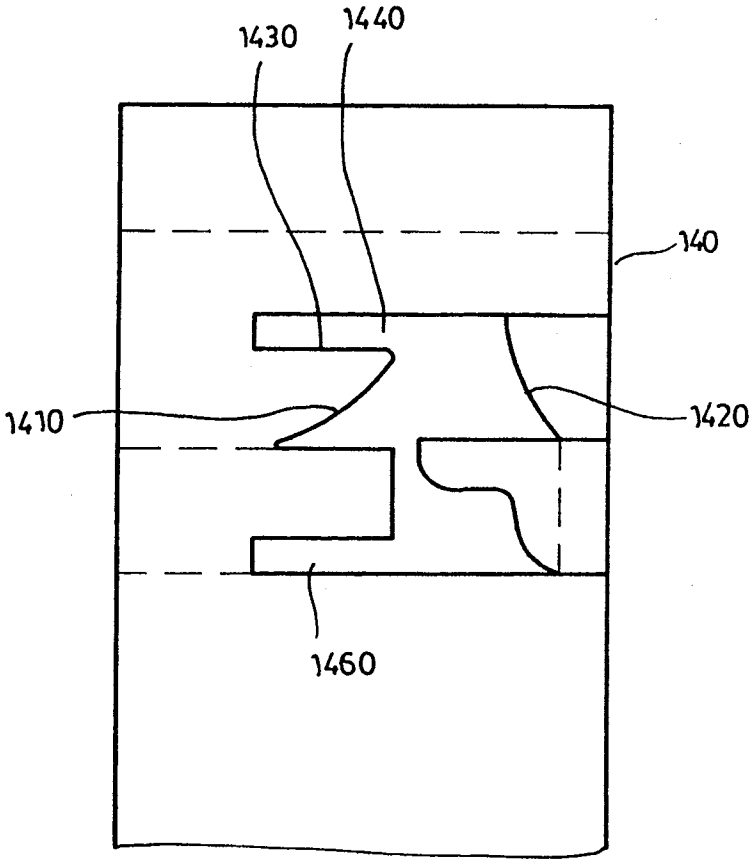
FIG. 13 is a plan view of a spread out retainer of the base piece of the second embodiment according to the present invention.
Figure 14:
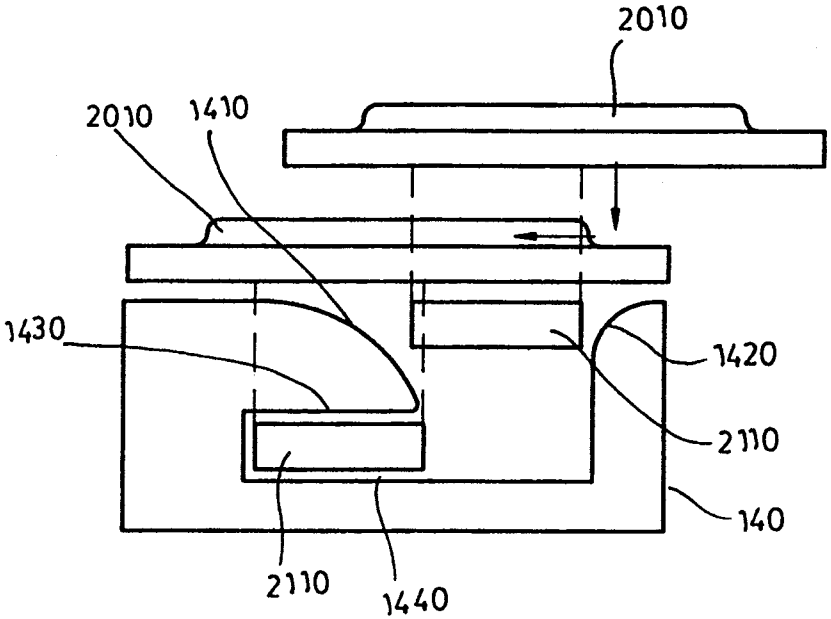
FIG. 14 is a sectional view, showing the engagement of the buckle member to the retainer, of the second embodiment according to the present invention.

Referring to FIGS. 9 and 12 of the drawings, one end of the base piece 100 has a pair of laterally formed hinge rings 110 rectangular receiving space 120 thereinbetween, a series of the pyramid projections disposed along each lateral side thereof for the strengthening and increasing the resilient effect of the base piece 100 and a retainer 140 provided on the other end. As shown in FIG. 13, the retainer 140 is spread out in a flat form with three broken lines indicating later bending positions in which comprises a slightly larger carved out space 1460 including a slit above the lowest broken line having a width slightly larger than the thickness of the metal strip, a first guiding member 1410 and a second guiding member 1420 at left and right side respectively, a gripping member 1430 and a locking space 1440 provided at the left side thereof.

With reference to FIG. 12, the retainer 140 is formed by folding over FIG. 13 along with those broken lines in such manner that, the first guiding member 1410 is bent downwardly close to the gripping member 1430 so as to define a narrow entrance between the outer wall and the guiding member 1410 for the passage of the W shaped buckle member 2110 from the tongue piece 200. The roughly L shaped protrudent portion at right side thereof in bent downwardly too to close the sloped portion of the second guiding member 1420. The sloped surface of the first and second guiding members 1410 and 1420 facilitate a smooth insertion of the buckle member 2110 into the retainer 140.

Figure 15:
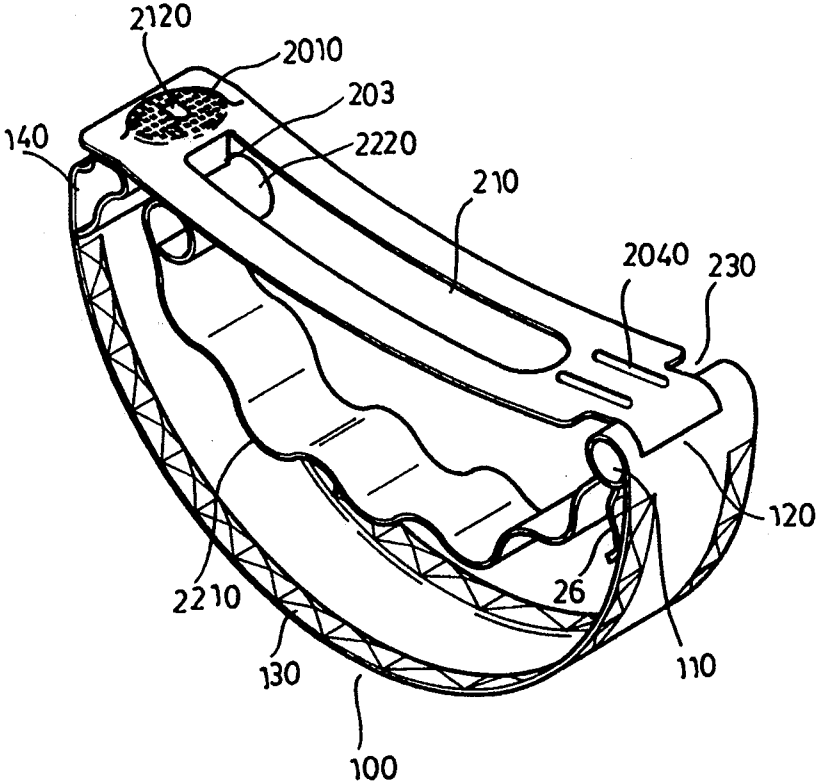
FIG. 15 is a perspective view of a fastened arched hairclip of the second embodiment according to the present invention.

Furthermore, the two series of the pyramid projections 130 and 130' can also be disposed to outer periphery of the base piece 100 so as to eliminate the step for attaching ornamental articles thereon in order to render the manufacturing process more economical (as shown in FIG. 15).

Figure 16:
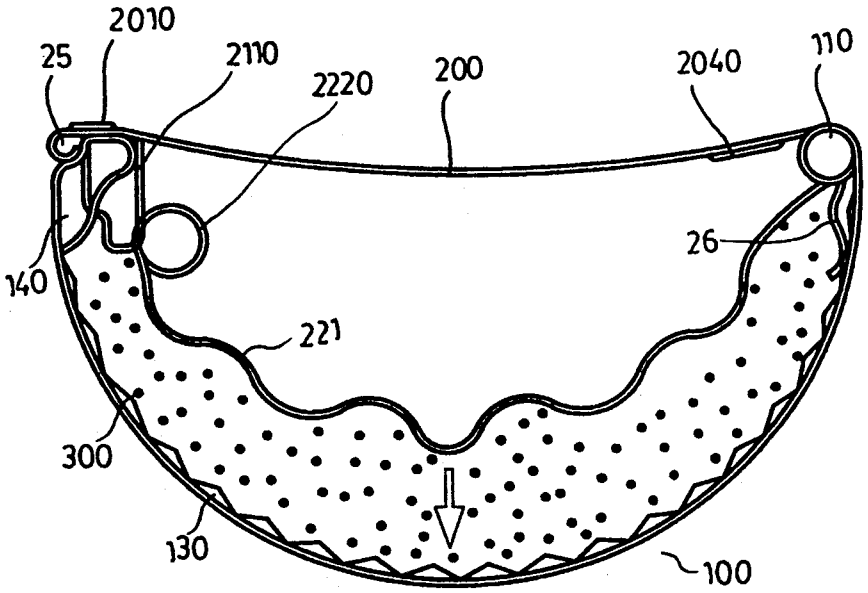
FIG. 16 is a sectional front view of the second embodiment according to the present invention showing how the hair is bound in the hairclip.

Referring to FIG. 15 and 16, to complete the assembly, the two protruding tabs 240 and 240' of the tongue piece 200 are inserted into the pair of the hinge rings 110 of the base piece 100 to have the spring plate 260 of the tongue piece 200 stopped against the inward periphery of the base piece 100, so as the cylinder 2220 of the spring strip 220 against the inward wall of the buckle member 2110, thereby, the buckle member 2110 of the tongue piece 200 is inserted and releasably locked in the retainer 140 when in close position and spring strip 220 below the tongue piece 200 is separated from the base piece 100 forming a gripping space therein between (as shown in FIG. 15).

The application of the hairclip of this second embodiment is similar to that recited above for the first embodiment of the invention. The only difference between them is that the first embodiment provides a pair of the gripping members 142 and 142' in the retainer 14 and this embodiment provides a single gripping member 1430 in the retainer 140 thereof.

When the hair is bound, and the tongue piece 200 is in close position, the resilient force of the spring strip 200 towards the two series of the pyramid projections 130 and 130' of the base piece 100, so as to force the hair bundle thereinbetween to be stable enough. Also, if the hair bundle therein in a wave style is too tense to the force the spring becoming flattened, the cylinder end 2220 will move upward to have the rectangular hole 2230 thereof engaged with the narrower end of the buckle member 2110 therein in order to release the tension. Therefore, the hair bundle therein would be safe without causing a shearing action and free from sliding off.

I claim:

1. An arched hairclip, comprising an arched base piece, having a pair of hinge rings at one end, said hinge rings having a rectangular receiving space defined thereinbetween, and a retainer at the other end thereof; said retainer being an inwardly bent plate body with an entrance opening on its top; said retainer having a first and a second guiding members downwardly disposed on left and right sides of said entrance opening respectively, at least two gripping parts and spaces being provided on at least one of said right and left guiding members; and a tongue piece having a thickness, said tongue piece comprising an upper portion in the shape of a elongate arch and a lower portion forming an undulated spring strip; a U-shaped buckle member being extended and connected to a first end of said upper portion of said tongue piece and having at least a tip at a free end of said buckle member; a press knurling being provided on said upper portion of said tongue piece near said buckle member, said press knurling having at least one retaining recess that said tip can be inserted therethrough for fixing up; two protruding tabs laterally extending from two sides of said tongue piece between said upper portion and said spring strip, each of said protruding tabs abutting a pair of inwardly stepped spaces to form a turning point for said tongue piece; an spring plate connected to said tongue piece between said upper portion and said spring strip and pointing downward for stopping against said arched base piece, said two protruding tabs being inserted into said hinge rings through said rectangular opening respectively so as to pivotally connect said arched base piece and said tongue piece.

2. An arched hairclip as recited in claim 1, wherein said arched base piece provides along its axis, a elongate strengthening slot.

3. An arched hairclip as recited in claim 1, wherein a free end of said spring strip forms a cylinder end.

4. An arched hair clip as recited in claim 1, wherein said upper portion and said spring strip each has an elongate slot along its axis for increasing elasticity.

5. An arched hairclip as recited in claim 1, said press knurling further comprises a U-shaped reinforcement groove, with a depth equal to the thickness of said tongue piece for receiving said tips which pass through said at least one retaining recess.

6. An arched hairclip, comprising an arched base piece, having a pair of hinge rings at one end, said hinge ring having a rectangular receiving space defined thereinbetween, and a retainer at the other end thereof; said retainer being an inwardly bent plate body with an entrance opening on its top; said retainer having a first and a second guiding members downwardly disposed on left and right sides of said entrance opening respectively, a gripping member being provided on at least one of said left and right guiding members, and a locking space being provided next to said gripping member; and a tongue piece, said tongue piece comprising an upper portion in the shape of a elongate arch and a lower portion forming an undulated spring strip; a press knurling being in form of elliptic protrusion on said tongue piece near a first end of said upper portion of said tongue piece; said press knurling has a retaining recess disposed therein; an elongate slot being provided along the axis of said upper portion of said tongue piece; a roughly W shaped buckle member extending from a side of said slot near said press knurling, said buckle member having a tip extending from a free end thereof said tip being passed through said retaining recess and bent to be disposed on said receiving groove; said tongue piece further comprising two symmetrical and lateral protruding tabs on two sides of its mid-section with at least two turning spaces abutting one side thereof; said spring strip having a width narrower than said upper portion of said tongue piece; an spring plate being connected to said tongue piece, located between said upper portion and said spring strip and pointing downward for stopping against said arched base piece; said two protruding tabs being inserted into said hinge rings through said rectangular opening respectively so as to pivotally connect said arched base piece and said tongue piece.

7. An arched hairclip as recited in claim 6, wherein said arched base piece has two series of pyramid projections along two sides of said arched base piece.

8. An arched hairclip as recited in claim 6, wherein a free end of said spring strip being rolled to form a cylinder end.

9. An arched hairclip as recited in claim 6, wherein said press knurling is in form of an elliptic protrusion.

* * * * *